US005386780A

United States Patent [19]

Klein

[11] Patent Number: 5,386,780

[45] Date of Patent: Feb. 7, 1995

[54] METHOD AND APPARATUS FOR EXTENDED TIME DELAY OF THE DETONATION OF A DOWNHOLE EXPLOSIVE ASSEMBLY

[75] Inventor: Dieter N. Klein, Houston, Tex.

[73] Assignee: Halliburton Company, Houston, Tex.

[21] Appl. No.: 964,172

[22] Filed: Oct. 21, 1992

[51] Int. Cl.[6] ..... F42B 3/00; C06D 5/04

[52] U.S. Cl. ..... 102/313; 102/312; 102/275.3; 102/275.7

[58] Field of Search ..... 102/312, 313, 275.3, 102/275.7

[56] References Cited

U.S. PATENT DOCUMENTS

| | | | |
|---|---|---|---|
| 3,041,914 | 7/1962 | Gurton et al. | 102/275.7 X |
| 4,614,156 | 9/1986 | Colle, Jr. et al. | 102/312 |
| 4,836,109 | 6/1989 | Wesson et al. | 102/312 |
| 4,911,076 | 3/1990 | Rowe | 102/275.3 |
| 5,062,485 | 11/1991 | Wesson et al. | 166/297 |
| 5,162,606 | 11/1992 | Jacob | 102/275.7 X |

*Primary Examiner*—Peter A. Nelson

*Attorney, Agent, or Firm*—Tracy W. Druce; Michael L. Lynch

[57] ABSTRACT

A method and apparatus adapted to provide a time delay between the hydraulic actuation of the firing head assembly by fluid pressure and the detonation of a downhole explosive device used in subterranean wells, such as a perforating gun. In a preferred embodiment, the firing head assembly can be quickly and easily connected in a tubing string intermediate the ported sub and the perforating gun or other explosive device. In one preferred embodiment, the hydraulically-actuated firing head assembly is provided with five combustible columns which are generally coextensive. When the fluid pressure applied to the firing head assembly is sufficient to actuate the firing head assembly, the actuation mechanism, such as a firing piston, initiates a combustive reaction in one end of the first combustible column. When the combustive reaction reaches the other end of the first combustible column, it is communicated to one end of the second combustible column. The second combustible column likewise combusts and communicates the combustive reaction to one end of the third combustible column. This cycle continues through the third, fourth and fifth combustible columns. When the combustive reaction reaches the end of the fifth combustible column, the combustive reaction is communicated to and detonates the perforating gun or other downhole explosive device.

19 Claims, 3 Drawing Sheets

METHOD AND APPARATUS FOR EXTENDED TIME DELAY OF THE DETONATION OF A DOWNHOLE EXPLOSIVE ASSEMBLY

BACKGROUND OF THE INVENTION

The present invention relates generally to improved methods and apparatus for use actuating an explosive charge downhole in a well bore. More specifically, the present invention relates to methods and apparatus for performing such actuation through use of a time delay apparatus which provides a relatively long duration delay through use of a series of combustible columns which combust in a predetermined, sequential order.

As is well known in the art, downhole explosive devices are utilized downhole in well casing to detonate explosive shaped charges which perforate the well casing and surrounding formation. A downhole explosive device, such as a perforating gun, is typically actuated through use of a firing head which is responsive to either mechanical forces or fluid pressure. So-called mechanically-actuated firing heads are typically responsive to an impact, such as may be provided by the dropping of a detonating bar through the tubing to impact an actuation piston in the firing head.

In many situations, however, mechanically-actuated firing heads do not provide sufficient reliability for use in the wellbore because the wellbore environment includes such interferences to the dropping detonating bar as debris and particles settling out from the heavy drilling muds. Also, it is frequently desirable to monitor various downhole parameters, such as temperature and pressure, through the use of instruments mounted between the tubing string and the firing head. These non-fullbore opening devices typically will not permit a detonating bar to pass through to the firing head. In such applications, pressure responsive, or so-called "hydraulically-actuated", firing heads are utilized.

Hydraulically-actuated firing heads are responsive to a source of fluid pressure, either in the well tubing or the well annulus, which moves an actuation piston in the firing head to initiate detonation of the perforating gun. Such firing heads require a specific source of substantial fluid pressure. However, it is often desirable to perforate the casing underbalanced. In such a situation, a time delay is desired between the time when the actuation signal is received by the firing head (via the hydraulic pressure) and the time when the actuation signal is transmitted from the firing head to the explosive device, detonating the explosive shaped charges and perforating the well casing. During this time delay, the pressure in the casing can be adjusted from the pressure required to actuate the hydraulically-actuated firing head to the pressure desired during the perforation of the well casing.

One conventional method of providing a time delay is to provide the firing head assembly with a relatively slowly combustible column between the firing piston and the explosive charges. One such combustible column which is known to provide such a time delay is a tungsten column. An exemplary time delay firing head utilizing such a tungsten column is disclosed in U.S. Pat. No. 4,614,156, issued Sep. 30, 1986, to Colle, Jr. et al., and assigned to the assignee of the present invention. The disclosure of U.S. Pat. No. 4,614,156 is hereby incorporated herein by reference for all purposes. By adjustment of the length of the column between the firing piston and the explosive charges, the desired time delay can be provided. One advantage of this method is that a time delay of a relatively definite period may be provided.

One side effect of using such a combustible column in the firing head assembly is that the firing head assembly is necessarily lengthened to provide for the elongate combustible column. As a result, the firing head assembly is more difficult to assemble into the tool string on the job site. Additionally, there are practical limitations upon the length of a time delay which is feasible with a single extended delay column.

In addition, due to its length, the longer firing head assembly presents difficulties in manufacturing and shipping. This longer firing head assembly may also present additional problems in some downhole applications where a longer tool string is disadvantageous.

In the prior art, one solution to the problems in manufacturing and shipping is to provide a time delay by longitudinally connecting a series of shorter tungsten delay columns. Such a design is disclosed in U.S. Pat. No. 5,062,485 to Wesson et al. This design is useful in applications requiring a relatively short duration delay. However, in applications requiring a relatively long duration delay, a number of these shorter tungsten delay column units are required. In such applications, this design does not overcome the problems at the job site associated with the assembly of a series of delay column units and the length of the resulting tool string downhole.

In addition, these delay column units, each incorporating a tungsten delay column, are designed to be screwed into a tool string in the field as needed. As a result, a detonating cord cannot be potted in place from one tungsten delay column to the next to communicate the combustive reaction therebetween. Instead, an explosive charge, firing piston and initiator are necessary to communicate the combustive-reaction from one of these delay column units to the next. Because of the requirement of these additional parts in each of the shorter tungsten delay column units, this design may not be economically efficient, from either a manufacture or shipping viewpoint, in applications requiring a relatively long duration delay. Also, as additional explosive charge/firing piston/initiator combinations are used, there is an increased possibility that one of the explosive charge/firing piston/initiator combinations will not fire properly. Finally, the additional delay columns require additional time to be assembled into the tool string in the field.

Accordingly, the present invention provides new methods and apparatus whereby detonation is delayed through use of a single, abbreviated delay apparatus utilizing a plurality of generally coextensive, tungsten delay columns. Because the apparatus is a shorter, solitary unit, it is more easily shipped and is more easily and quickly assembled into a tool string in the field. Since the apparatus is manufactured as a single unit, the ends of a detonating cord can be potted in place in the combustible columns during manufacture. Thus, the combustive reaction may be communicated from one combustible column to the next generally coextensive combustible column through use of a detonating cord, thereby eliminating the need for an explosive charge/-firing piston/initiator combination therebetween. Thus, the problems associated with the conventional methods and apparatuses for providing a time delay are avoided.

SUMMARY OF THE INVENTION

The above-noted and other drawbacks and problems associated with the prior art are overcome by the method and apparatus disclosed herein for detonating an explosive in a well, such as a perforating gun. According to the invention, a time delay is provided between the hydraulic actuation of the firing head assembly by fluid pressure and detonation of the explosive. The apparatus of the present invention comprises a firing head assembly and an explosive. The firing head assembly includes an actuation mechanism and a delay mechanism.

In one preferred embodiment of the invention, the firing head will be responsive to an actuation signal developed by the application of fluid pressure to a hydraulically-actuated firing head. When the fluid pressure applied to the firing head assembly is sufficient to actuate the firing head assembly, the actuation mechanism generates an ignition signal. In one preferred embodiment, the actuation mechanism comprises a hydraulically-actuated firing piston having a firing pin extending therefrom. The firing piston is held in a first position by a plurality of shear pins. When the force acting on the firing piston due to the fluid pressure exceeds the combined design limits of the shear pins, the pins shear. The hydraulic pressure urges the firing piston downward until it reaches a second position wherein the firing pin strikes an initiator, generating the ignition signal, such as a combustive reaction in a detonating cord.

The delay mechanism includes a plurality of delay portions which are arranged to be sequentially operative. At least two of the plurality of delay portions are arranged in generally coextensive relation to one another. The delay mechanism is operable to receive the ignition signal and to generate a detonation signal after the ignition signal has been communicated sequentially through the plurality of delay portions. The explosive is operably coupled to the delay mechanism to receive the detonation signal and to detonate when the detonation signal is received. In one preferred embodiment, the delay portions are elongate columns which are arranged in generally coextensive relation to one another. In another preferred embodiment, each delay portion comprises an elongate combustible column. For example, the combustible columns may consist primarily of a tungsten and teflon mixture, with the teflon used as a binding mechanism. The mixture at the ends of each column may also include a flash igniter compound to facilitate communication of the combustive reaction.

In one particularly preferred embodiment, the delay mechanism comprises five combustible columns which are arranged in generally parallel, coextensive, relation to one another. The five combustible columns are connected in series by detonating cords, so that the columns will sequentially combust. In this embodiment, a combustive reaction is generated by the firing pin striking the initiator, as has already been described. The combustive reaction is communicated from the initiator to the first combustible column in the series by a first detonating cord. Each of the five combustible columns sequentially combusts, with the combustive reaction being communicated from one column to the next by cooperatively arranged detonating cords. After the last in the series of the five combustible columns has combusted, a deposit of highly explosive material is ignited proximate the last column. The explosion of the deposit of highly explosive material communicates the combustive reaction to a booster, which in turn communicates the combustive reaction to a detonating cord. The detonating cord combusts to the explosive, which is detonated.

DETAILED DESCRIPTION OF A PREFERRED EMBODIMENT

Figure 1:
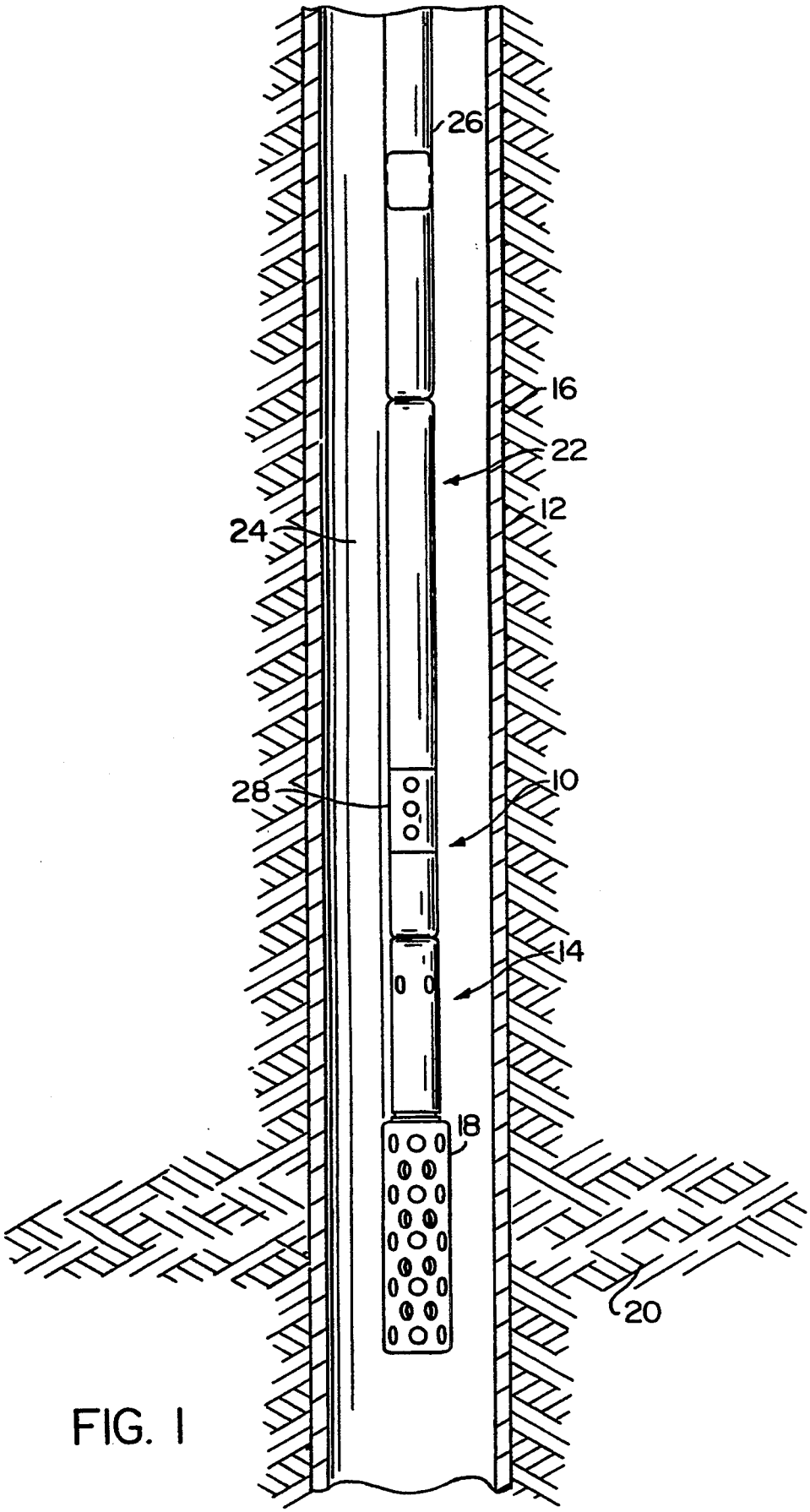
FIG. 1 schematically depicts a tool string including a perforating apparatus in accordance with the present invention disposed within a well, illustrated partially in vertical section.

Referring now to FIG. 1, therein is depicted one example of a perforating apparatus in accordance with the present invention, shown generally at 10, disposed within a well 12. Perforating apparatus 10 includes a hydraulically-actuated firing head assembly, shown generally at 14, which incorporates a time delay apparatus 30 and an actuation mechanism 11 each in accordance with the present invention. Hydraulically-actuated firing head assembly 14 is threadably coupled at its lower end to perforating gun 18. Well casing 16 lines the bore of well 12 in a manner well known to those skilled in the art. Perforating apparatus 10 is inserted into the bore of well 12 until perforating gun 18 is proximate formation 20 which is to be perforated. Perforating apparatus 10 is said to be "downhole" when it is inserted into the bore of well casing 16.

Perforating apparatus 10 is coupled in, and forms a part of, a tool string, shown generally at 22. Well annulus 24 is formed between tool string 22 and well casing 16. Tool string 22 is suspended in well 12 from tubing string 26. Tool string 22 includes a ported sub 28 providing fluid communication between annulus 24 and the interior of tool string 22. Coupled in tool string 22 beneath ported sub 28 is perforating apparatus 10.

Figure 2:
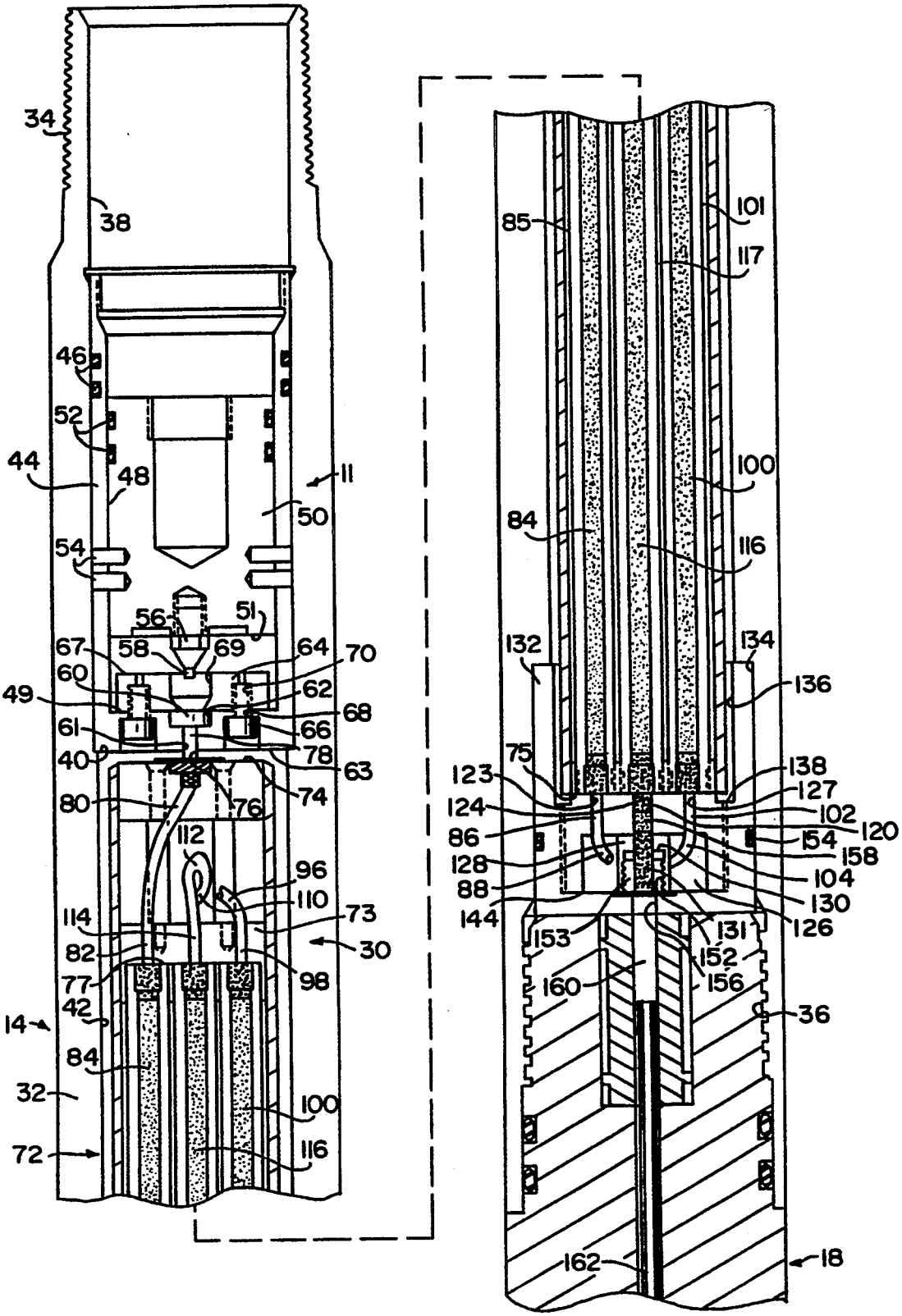
FIG. 2 depicts a cross-sectional side view of the perforating assembly of FIG. 1, comprising a firing head assembly, including the time delay apparatus, and the upper portion of a perforating gun.

Referring now to FIG. 2, therein is schematically depicted hydraulically-actuated firing head assembly 14 in accordance with the present invention, coupled to perforating gun 18. In one preferred embodiment, firing head assembly 14 includes a housing 32 having an upper "male", or externally-threaded, extension 34 at one end for coupling firing head assembly 14 to a tubing string for lowering into a well bore, or for coupling other downhole devices to firing head assembly 14. Housing 32 has a lower "female", or internally-threaded, cavity 36 at the other end for coupling firing head assembly 14 to a downhole device, such as perforating gun 18. Thus, hydraulically-actuated firing head assembly 14 can be quickly and easily screwed into tool string 22 between ported sub 28 and perforating gun 18. Actuation mechanism, shown generally at 11, is located in the upper portion of firing head assembly 14. Time delay apparatus 30 is located below actuation mechanism 11.

Housing 32 has a first, relatively large diameter counterbore 38 bounded at its lower extremity by an annular shoulder 40. Beginning at an inner edge of annular shoulder 40 is a downwardly extending second, relatively smaller diameter, counterbore 42. Second housing counterbore 42 extends downwardly from annular shoulder 40 through a middle region of housing 32. A piston retainer 44 is releasably retained within first housing counterbore 38. Piston retainer 44 includes two O-ring seals 46 to sealingly engage first housing counterbore 38. Piston retainer 44 is provided with a first, relatively large diameter, piston counterbore 48, which is bounded at its lower extremity by annular shoulder 49 of piston retainer 44.

A hydraulically-responsive piston 50 is held in a first, unactuated, position relative to first piston counterbore 48 by a plurality of shear pins 54. In one preferred embodiment, piston 50 is retained in place in this first position by four shear pins 54. Two O-ring seals 52 provide a fluid tight seal between the piston 50 and first piston counterbore 48 of piston retainer 44. Piston retainer 44 is fitted within first housing counterbore 38 and is prevented from moving downwardly within housing 32 by annular shoulder 40. The inner surface of piston retainer 44 is dimensioned to fit closely against the outer surface of the piston 50.

A firing pin 56 is threadably secured to the bottom of piston 50. Beginning at an inner edge of annular shoulder 49 of piston retainer 44 is a downwardly extending second, relatively smaller diameter piston counterbore 62. Initiator 60 is held in second piston counterbore 62 of piston retainer 44 by primer retainer 64. Primer retainer 64 is secured to annular shoulder 49 of piston retainer 44 by a pair of screws 66, which are threadably screwed through openings 68 in piston retainer 44 and into threaded apertures 70 in primer retainer 64. Primer retainer 64 has a concentric opening 69 therethrough shaped to receive the lower portion of firing pin 56 and guide narrow projection 58 into engagement with initiator 60. Extending below initiator 60 through lower wall 63 of piston retainer 44 is passageway 61. Passageway 61 permits combustive communication between initiator 60 and second housing counterbore 42.

In a manner known to the art, when the fluid pressure in tubing string 26 reaches a predetermined level, established by the yield strength of shear pins 54, shear pins 54 are sheared and piston 50 is urged downward under hydraulic pressure to a second position. As piston 50 moves to this second position, narrow projection 58 of firing pin 56 impacts against initiator 60.

Time delay apparatus 30 includes a delay column assembly, shown generally at 72. Delay column assembly 72 is located directly under piston retainer 44, with upper wall 74 of delay column assembly 72 abutting lower wall 63 of piston retainer 44. Upper wall 74 is provided with a passageway 76 which is adjacent passageway 61 of piston retainer 44. Initial end 78 of first detonating cord 80 is secured proximate initiator 60. First detonating cord 80 extends through passageway 61 of piston retainer 44 and passageway 76 of upper wall 74.

Figure 3A:
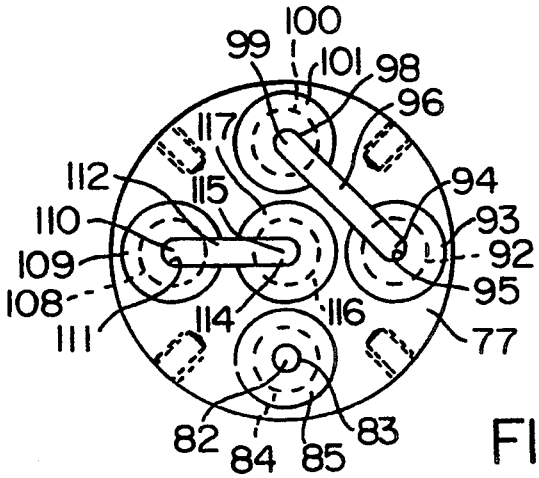
FIG. 3A depicts a cross-sectional view from above and below the delay column assembly of the time delay apparatus of FIG. 2.
Figure 3B:
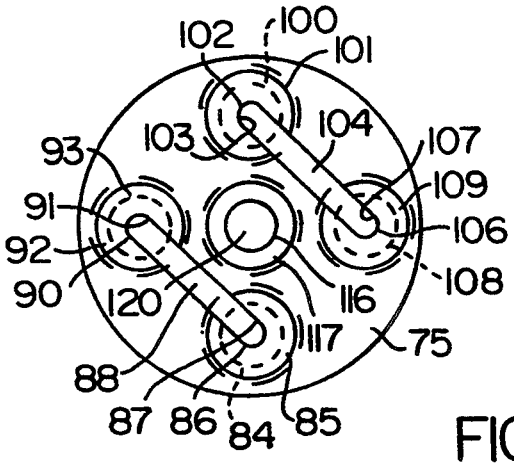
FIG. 3B depicts a cross-sectional view from below the delay column assembly of the time delay apparatus of FIG. 2.

FIG. 3A shows upper column enclosure 77 of delay column assembly 72 as viewed from above, with upper plug 73 removed to better illustrate delay column assembly 72. FIG. 3B shows lower column enclosure 75 of delay column assembly 72 as viewed from below, with lower plug 132 removed to better illustrate delay column assembly 72. Referring now to FIGS. 2, 3A, and 3B terminal end 82 of first detonating cord 80 extends through passageway 83 in the upper end of first chamber 85 and is potted in place in the upper end of first delay column 84. Initial end 86 of second detonating cord 88 extends through passageway 87 in the lower end of first chamber 85 and is potted in place in the lower end of first delay column 84. Terminal end 90 of second detonating cord 88 extends through passageway 91 in the lower end of second chamber 93 and is potted in place in the lower end of second delay column 92. Initial end 94 of third detonating cord 96 extends through passageway 95 in the upper end of second chamber 93 and is potted in place in the upper end of second delay column 92. Terminal end 98 of third detonating cord 96 extends through passageway 99 in the upper end of third chamber 101 and is potted in place in the upper end of third delay column 100.

Initial end 102 of fourth detonating cord 104 extends through passageway 103 in the lower end of third chamber 101 and is potted in place in the lower end of third delay column 100. Terminal end 106 of fourth detonating cord 104 extends through passageway 107 in the upper end of fourth chamber 109 and is potted in place in the lower end of fourth delay column 108. Initial end 110 of fifth detonating cord 112 extends through passageway 111 in the upper end of fourth chamber 109 and is potted in place in the upper end of fourth delay column 108. Terminal end 114 of fifth detonating cord 112 extends through passageway 115 in the upper end of fifth chamber 117 and is potted in place in the upper end of fifth delay column 116.

First delay column 84, second delay column 92, third delay column 100 and fourth delay column 108 are arranged symmetrically around fifth delay column 116, with first delay column 84 on the opposite side of fifth delay column 116 from third delay column 100 and with second delay column 92 on the opposite side of fifth delay column 116 from fourth delay column 108. Thus, when viewed from above the upper column enclosure 77 (as is shown in FIG. 3A), the delay columns are in a counterclockwise order of first 84, second 92, third 100 and fourth 108, with the fifth delay column 116 centered.

As has already been described, first delay column 84 is inside of first chamber 85. An annular gap is defined between first delay column 84 and first chamber 85. Similarly, an annular gap is defined between each of delay columns 92, 100, 108, 116 and each of chambers 93, 101, 109, 117, respectively.

As a delay column combusts, hot gases are generated. These gases exit the delay column and fill the annular gap between the delay column and the chamber. Chambers 85, 93, 101, 109, 117 are preferably each formed of a material which has good heat dissipating qualities. One such material that has been found to effectively dissipate heat is stainless steel. The combined effect of the annular gap and the chamber formed of a heat dissipating material is to inhibit the rise in temperature in the chamber during combustion of a delay column in that chamber. Since the increase in temperature is restricted, the delay column combusts at a reliable, uniform rate.

With continuing reference to FIGS. 2, 3A, and 3B lower plug 132 is releasably received within a third, relatively large diameter counterbore 134 of the lower portion of housing 32. Lower plug 132 includes an O-ring seal 154 to sealingly engage third housing counterbore 134. Lower plug 132 has a first, relatively large diameter plug counterbore 136 bounded at its lower extremity by plug annular shoulder 138. Lower plug 132 has a second, relatively small diameter plug counterbore 124. Second plug counterbore 124 extends from first plug counterbore 136 to and through lower wall 144 of lower plug 132.

A plug recess 126 is formed in the lower section of lower plug 132. Plug recess 126 is donut-shaped, with plug extension 128 extending through the central region of plug recess 126. Plug recess 126 is closed by lower wall 144 of lower plug 132. Second plug counterbore 124 extends into plug extension 128 to and through plug extension annular shoulder 130 and into plug output cup 131. A third, relatively large diameter plug counterbore 152 is formed in plug extension 128 below plug extension annular shoulder 130. Third plug counterbore 152 releasably retains output cup retainer 153.

Initial end 86 of second detonating cord 88 extends from first delay column 84 to plug recess 126 through cord passageway 123. Initial end 102 of fourth detonating cord 104 extends from third delay column 100 to plug recess 126 through cord passageway 127. In a like manner, terminal end 90 of second detonating cord 88 extends from plug recess 126 to second delay column 92 through a cord passageway (not shown). Terminal end 106 of fourth detonating cord 104 extends from plug recess 126 to fourth delay column 108 through a cord passageway (not shown).

Lower wall 144 closes plug recess 126. A deposit of a flash igniter compound 120 extends from the lower end of fifth delay column 116 into second plug counterbore 124. A deposit of a highly explosive material 158 is located in second plug counterbore 124 proximate and below the deposit of flash igniter compound 120. Plug output cup 131 extends from the deposit of highly explosive material 158 to counterbore 156 of lower wall 144. Counterbore 156 permits combustive communication between plug output cup 131 and booster 160.

Thus, the deposit of flash igniter compound 120 is located between the lower end of fifth delay column 116 and the deposit of highly explosive material 158. One flash igniter compound which may be used is known in the art as A1A. In one preferred embodiment, the deposit of highly explosive material 158 is approximately 100 milligrams of titanium potassium chlorate ($TiKCLO_4$). Output cup 131 is located below the deposit of highly explosive material 158, thereby allowing combustive communication between the deposit of highly explosive material 158 and booster 160 via output cup 131 and counterbore 156. Booster 160 is secured to the upper end of sixth detonating cord 162. The lower end of sixth detonating cord 162 is secured to the explosive shaped charges in perforating gun 18 in a manner well known to the art. The lower end of sixth detonating cord 162 and the explosive shaped charges of perforating gun 18 are not shown in FIG. 2 in order to better illustrate firing head assembly 14.

As has already been described, chambers 85, 93, 101, 109, 117 are preferably made of material having good heat dissipating qualities. In one preferred embodiment, chambers 85, 93, 101, 109, 117 are made of stainless steel alloy. Delay columns 84, 92, 100, 108, 116 consist primarily of a tungsten and teflon mixture, of circular cross-section, with the teflon used as a binding mechanism. One combustible delay column which may be used for delay columns 84, 92, 100, 108, 116 is available through Quantec, Inc. This delay column will combust in a stainless steel, tube-like chamber, of circular cross-section, as described herein at a rate of approximately 40 seconds per inch. Thus, a delay column of 10.5 inches will combust from one end to the other in approximately 7 minutes. A delay column assembly comprising five 10.5 inch delay columns coupled in series can provide a 35 minute delay.

Each end of each delay column should preferably be mixed with a flash igniter compound to facilitate the passage of the combustive reaction. One such flash igniter compound which may be used is known in the art as A1A. Initiator 60 is of a type known to those skilled in the art. Booster 160 also is of a type known to those skilled in the art. When booster 160 detonates, it preferably yields between 70,000.–120,000. p.s.i. Boosters which may be used include PYX, HMX and RDX standard boosters. In one preferred embodiment, booster 160 is a bi-directional booster. Detonating cords 80, 88, 96, 104, 112, 162 are likewise of a type known to those skilled in the art as "primacord." One type of detonating cord which may be used is a PYX standard detonating cord which is available through Ensign-Bickford Company.

The operation of perforating apparatus 10 is as follows. Perforating apparatus 10 is assembled on the surface as has been hereinbefore described. Once assembled, perforating apparatus 10 is inserted down the bore of well casing 16 until perforating gun 18 is proximate the oil or gas formation 20 to be perforated. Piston 50 is held in place in piston retainer 44 by shear pins 54.

When it is desired to actuate the delay device 10, pressure will be applied to fluid in tubing string 26 to shear shear pins 54. Shear pins 54 will hold hydraulically-actuated piston 50 in place up to their design limits. The shear pin double value should preferably be approximately 1000 lbs. force (500 lbs. force per pin) for many applications. When the fluid pressure in tubing string 26 exceeds the design limits of shear pins 54, shear pins 54 shear. The fluid pressure in tubing string 26 urges hydraulically-actuated piston 50 downward until projection 58 of firing pin 56 strikes initiator 60. When initiator 60 is struck, initiator 60 initiates a combustive reaction in initial end 78 of first detonating cord 80. The downward motion of piston 50 is arrested when lower surface 51 of piston 50 impacts upon upper surface 67 of primer retainer 64.

First detonating cord 80 combusts from initial end 78 to terminal end 82, where the combustive reaction is communicated to the upper end of first delay column 84. First delay column 84 combusts from its upper end to its lower end, where the combustive reaction is communicated to initial end 86 of second detonating cord 88.

Second detonating cord 88 combusts from initial end 86 to terminal end 90, where the combustive reaction is communicated to the lower end of second delay column 92. Second delay column 92 combusts from its lower end to its upper end, where the combustive reaction is communicated to initial end 94 of third detonating cord 96.

Third detonating cord 96 combusts from initial end 94 to terminal end 98, where the combustive reaction is communicated to the upper end of third delay column 100. Third delay column 100 combusts from its upper end to its lower end, where the combustive reaction is communicated to initial end 102 of fourth detonating cord 104.

Fourth detonating cord 104 combusts from initial end 102 to terminal end 106, where the combustive reaction is communicated to the lower end of fourth delay column 108. Fourth delay column 108 combusts from its lower end to its upper end, where the combustive reaction is communicated to initial end 110 of fifth detonating cord 112.

Fifth detonating cord 112 combusts from initial end 110 to terminal end 114, where the combustive reaction is communicated to the upper end of fifth delay column 116. Fifth delay column 116 combusts from its upper end to its lower end.

As the combustive reaction proceeds sequentially through each of delay columns 84, 92, 100, 108, 116, the pressure in the tubing string 26 may be reduced to the desired pressure. When the combustive reaction reaches the lower end of fifth delay column 116, the deposit of flash igniter compound 120, such as A1A, is ignited. The deposit of flash igniter compound 120 combusts, igniting the deposit of highly explosive material 158, such as titanium potassium chlorate ($TiKCLO_4$). The deposit of highly explosive material 158 explodes into output cup 131, communicating the combustive reaction to booster 160. Booster 160 detonates, passing the combustive reaction to sixth detonating cord 162. Sixth detonating cord 162 combusts along its length to the lower end of sixth detonating cord 162, where it detonates the explosive shaped charges of perforating gun 18 in a manner well known to the art. The lower end of sixth detonating cord 162 and the explosive shaped charges of perforating gun 18 are not shown in FIG. 2 in order to better illustrate firing head assembly 14. The explosive shaped charges of perforating gun 18 then perforate the well casing 16 and formation 20.

Although the time delay apparatus has only been illustrated herein as having five delay columns, it is important to note that the apparatus is not limited to this number of delay columns. As will be understood by those skilled in the art, a shorter time delay will be provided if fewer delay columns are used. For example, a time delay apparatus designed for five delay columns could easily be converted to a two, three or four delay column apparatus by changing the connections between columns. Likewise, if a longer delay is desired, a second time delay apparatus adapted to receive the combustive reaction from the first time delay apparatus may be utilized, thus providing approximately twice the time delay of a single delay apparatus. Likewise, the time delay apparatus may be adapted to communicate the actuation signal to, or to receive the actuation signal from, a prior art, single column delay device.

The description of the present invention has been presented for purposes of illustration and description, but is not intended to be exhaustive or limit the invention in the precise form disclosed. For example, the described delay column assembly could be incorporated into a mechanically-actuated firing head assembly. Many additional modifications and variations may be made to the techniques and structures described and illustrated herein.

What is claimed is:

1. A system for detonating an explosive in a well, said system comprising:

(a) a firing head assembly, said firing head assembly including (1) an assembly housing, (2) an actuation mechanism, said actuation mechanism contained within said assembly housing, said actuation mechanism operable to receive an actuation signal and to generate an ignition signal in response thereto, (3) a delay mechanism, said delay mechanism contained within said assembly housing, said delay mechanism including a plurality of delay portions arranged to be sequentially operative, at least two of said plurality of delay portions arranged in generally coextensive relation to one another, said delay mechanism operable to receive said ignition signal and to generate a detonation signal after said ignition signal has been communicated sequentially through said plurality of delay portions; and (b) an explosive operably coupled to said firing head assembly, said explosive operable to receive said detonation signal and to detonate when said detonation signal is received.

2. The system of claim 1, wherein each of said delay portions comprises a combustible column.

3. The system of claim 2, wherein said combustible columns comprise tungsten and teflon.

4. The system of claim 3, wherein the ends of each of said combustible columns further comprise a flash igniter compound.

5. The system of claim 1, wherein said delay mechanism further includes a plurality of chambers, each of said delay portions at least partially contained in each of said chambers.

6. A system for perforating a well, said system comprising:

(a) a firing head assembly, said firing head assembly including (1) an assembly housing, (2) an actuation mechanism, said actuation mechanism contained within said assembly housing, said actuation mechanism operable to receive an actuation signal and to generate an ignition signal in response thereto, (3) a delay mechanism, said delay mechanism contained within said assembly housing, said delay mechanism including a plurality of delay portions arranged to be sequentially operative, at least two of said plurality of delay portions arranged in generally coextensive relation to one another, said delay mechanism operable to receive said ignition signal and to generate a detonation signal after said ignition signal has been communicated sequentially through said plurality of delay portions;

(b) a perforating gun operably coupled to said firing head assembly, said perforating gun operable to receive said detonation signal and to detonate when said detonation signal is received.

7. The system of claim 6, wherein each of said delay portions comprises a combustible column.

8. The system of claim 7, wherein said combustible columns comprise tungsten and teflon.

9. The system of claim 8, wherein the ends of each of said combustible columns further comprise a flash igniter compound.

10. The system of claim 6, wherein said delay mechanism further includes a plurality of chambers, each of said delay portions at least partially contained in each of said chambers.

11. A firing head assembly, said assembly comprising:

(a) an assembly housing;

(b) an actuation mechanism, said actuation mechanism contained within said assembly housing, said actuation mechanism operable to receive an actuation signal and to generate an ignition signal in response thereto;

(c) a delay mechanism, said delay mechanism contained within said assembly housing, said delay mechanism including a plurality of delay portions arranged to be sequentially operative, at least two of said plurality of delay portions arranged in generally coextensive relation to one another, said delay mechanism operable to receive said ignition signal and to generate a detonation signal after said ignition signal has been communicated sequentially through said plurality of delay portions.

12. The firing head assembly of claim 11, wherein said delay mechanism further includes a plurality of chambers, each of said delay portions at least partially contained in each of said chambers.

13. A firing head assembly, said assembly comprising:

(a) an assembly housing defining a bore at least partially therethrough;

(b) a detonating cord contained at least partially within said assembly housing;

(c) an actuation mechanism within said bore, said actuation mechanism moveable from a first, unactuated, position to a second, actuated, position in response to fluid pressure, said actuation mechanism initiating a combustive reaction in said detonating cord when said actuation mechanism is moved to said second, actuated, position;

(d) a plurality of combustible columns contained within said assembly housing, said plurality of combustible columns arranged to be sequentially operative, at least two of said plurality of combustible columns arranged so as to be at least partially coextensive with one another, said plurality of combustible columns operatively coupled to said detonating cord to receive said combustive reaction from said detonating cord and to pass said combustive reaction through said plurality of combustible columns, said plurality of combustible columns initiating a detonation signal after said combustive reaction has been passed through said plurality of combustible columns.

14. The firing head assembly of claim 13, wherein said combustible columns comprise tungsten and teflon.

15. The firing head assembly of claim 14, wherein the ends of each of said combustible columns further comprise a flash igniter compound.

16. A firing head assembly, said assembly comprising:

(a) an assembly housing defining a cylindrical bore at least partially therethrough;

(b) an initiator contained within said assembly housing;

(c) a detonating cord contained within said assembly housing;

(d) a piston within said cylindrical bore, said piston including a pin extending therefrom, said piston in a first, unactuated, position in which said pin is in spaced relation relative to said initiator, said piston moveable from said first, unactuated, position to a second, actuated, position in which said pin contacts said initiator in response to fluid pressure, said initiator initiating a combustive reaction in said detonating cord when said piston is moved to said second, actuated, position;

(e) a plurality of combustible columns contained within said assembly housing, said plurality of combustible columns arranged to be sequentially operative, each of said plurality of combustible columns arranged in generally coextensive relation to one another, said plurality of combustible columns operatively coupled to said detonating cord to receive said combustive reaction from said detonating cord and to pass said combustive reaction through said plurality of combustible columns, said plurality of combustible columns initiating a detonation signal after said combustive reaction has been passed through said plurality of combustible columns.

17. A system for detonating an explosive in a well, said system comprising (a) a firing head assembly, said firing head assembly including (1) an assembly housing, (2) an actuation mechanism, said actuation mechanism contained within said assembly housing, said actuation mechanism operable to receive an actuation signal and to generate an ignition signal in response thereto, (3) a delay mechanism, said delay mechanism contained within said assembly housing, said delay mechanism including a plurality of delay portions substantially circular in cross section and arranged to be sequentially operative, at least two of said plurality of delay portions arranged in generally coextensive relation to one another, said delay mechanism operable to receive said ignition signal and to generate a detonation signal after said ignition signal has been communicated sequentially through said plurality of delay portions; and (b) an explosive operably coupled to said firing head assembly, said explosive operable to receive said detonation signal and to detonate when said detonation signal is received; wherein said delay mechanism further includes a plurality of chambers, wherein each of said delay portions are at least partially contained within each of said chambers such that an annular gap is defined between each of said delay portions and each of said chambers.

18. A system for perforating a well, said system comprising:

(a) a firing head assembly, said firing head assembly including (1) an assembly housing, (2) an actuation mechanism, said actuation mechanism contained within said assembly housing, said actuation mechanism operable to receive an actuation signal and to generate an ignition signal in response thereto, (3) a delay mechanism, said delay mechanism contained within said assembly housing, said delay mechanism including a plurality of delay portions substantially circular in cross section and arranged to be sequentially operative, at least two of said plurality of delay portions arranged in generally coextensive relation to one another, said delay mechanism operable to receive said ignition signal and to generate a detonation signal after said ignition signal has been communicated sequentially through said plurality of delay portions;

(b) a perforating gun operably coupled to said firing head assembly, said perforating gun operable to receive said detonation signal and to detonate when said detonation signal is received; wherein said delay mechanism further includes a plurality of chambers, wherein each of said delay portions are at least partially contained within each of said chambers such that an annular gap is defined between each of said delay portions and each of said chambers.

19. A firing head assembly, said assembly comprising:

(a) an assembly housing defining a bore at least partially therethrough;

(b) a detonating cord contained at least partially within said assembly housing;

(c) an actuating mechanism within said bore, said actuation mechanism moveable from a first, unactuated, position to a second, actuated, position in response to fluid pressure, said actuation mechanism initiating a combustive reaction in said detonating cord when said actuation mechanism is moved to said second, actuated, position;

(d) a plurality of combustible columns substantially circular in cross section contained within said assembly housing, said plurality of combustible columns arranged to be sequentially operative, at least two of said plurality of combustible columns arranged so as to be at least partially coextensive with one another, said plurality of combustible columns operatively coupled to said detonating cord to receive said combustive reaction from said detonating cord and to pass said combustive reaction through said plurality of combustible columns, said plurality of combustible columns initiating a detonation signal after said combustive reaction has been passed through said plurality of combustible columns; and (e) a plurality of chambers contained within said assembly housing; wherein each of said combustible columns are at least partially contained within each of said chambers such that a generally annular gap is defined between each of said combustible columns and each of said chambers.

* * * * *